US008771531B2

(12) United States Patent
Furusawa et al.

(10) Patent No.: US 8,771,531 B2
(45) Date of Patent: Jul. 8, 2014

(54) METHOD OF PRODUCING SUBSTRATE FOR LIQUID EJECTION HEAD

(75) Inventors: Kenta Furusawa, Yokohama (JP); Shuji Koyama, Kawasaki (JP); Hiroyuki Abo, Tokyo (JP); Taichi Yonemoto, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 128 days.

(21) Appl. No.: 13/433,806

(22) Filed: Mar. 29, 2012

(65) Prior Publication Data

US 2012/0267342 A1 Oct. 25, 2012

(30) Foreign Application Priority Data

Apr. 19, 2011 (JP) ..... 2011-093014

(51) Int. Cl.
*B41J 2/16* (2006.01)

(52) U.S. Cl.
USPC ..... 216/27; 216/41; 216/51; 216/99; 216/102; 252/79.1; 252/79.5

(58) Field of Classification Search
None
See application file for complete search history.

(56) References Cited

U.S. PATENT DOCUMENTS 7,250,113 B2 7/2007 Komuro et al.
8,329,047 B2 * 12/2012 Nagami et al. ..... 216/27
8,492,281 B2 * 7/2013 Abo et al. ..... 438/700
2002/0191054 A1 * 12/2002 Liu et al. ..... 347/65
2003/0022397 A1 * 1/2003 Hess et al. ..... 438/11
2004/0259372 A1 * 12/2004 Komuro et al. ..... 438/745
2009/0218542 A1 * 9/2009 Isami et al. ..... 252/79.5
2010/0323526 A1 * 12/2010 Kishimoto et al. ..... 438/753
2011/0049092 A1 * 3/2011 Pan et al. ..... 216/27
2011/0151598 A1 * 6/2011 Abo et al. ..... 438/21
2012/0329181 A1 * 12/2012 Murakami et al. ..... 438/21

FOREIGN PATENT DOCUMENTS

JP 2005-035281 A 2/2005
JP 2009-206335 A 9/2009

* cited by examiner

*Primary Examiner* — Anita Alanko
(74) *Attorney, Agent, or Firm* — Fitzpatrick, Cella, Harper & Scinto

(57) ABSTRACT

A substrate for a liquid ejection head, including: forming a sacrifice layer on a first surface of a silicon substrate in a region in which a liquid supply port is to open, the sacrifice layer containing aluminum which is selectively etched with respect to the silicon substrate; forming an etching mask on a second surface which is a rear surface of the first surface of the silicon substrate, the etching mask having an opening corresponding to the sacrifice layer; a first etching step of etching the silicon substrate by using the etching mask as a mask and by using a first etchant containing 8 mass % or more and less than 15 mass % of tetramethylammonium hydroxide; and after the first etching step, a second etching step of removing the sacrifice layer by using a second etchant containing 15 mass % or more and 25 mass % or less of tetramethylammonium hydroxide.

10 Claims, 2 Drawing Sheets

METHOD OF PRODUCING SUBSTRATE FOR LIQUID EJECTION HEAD

BACKGROUND OF THE INVENTION

1. Field of the Invention

The present invention relates to a method of producing a substrate for a liquid ejection head used in a liquid ejection head. More particularly, the present invention relates to a method of producing a substrate for an ink jet head used in an ink jet recording head.

2. Description of the Related Art

In recent years, it is desired to etch an inkjet ink supply port with precision and to keep constant the distance between a heater and the ink supply port, thereby improving the performance of the ink jet recording head. For example, Japanese Patent Application Laid-Open No. 2005-35281 discloses a method in which a sacrifice layer is made of aluminum and an ink supply port is formed using an alkaline etchant.

Further, in order to improve the productivity, it is required to reduce the time taken to etch silicon. For example, as disclosed in Japanese Patent Application Laid-Open No. 2009-206335, by the use of an etchant containing an alkaline compound which is a mixture of an organic alkaline compound and an inorganic alkaline compound and containing any one of silicon or a silicon compound, the time taken for anisotropic etching of silicon is attempted to be reduced.

However, depending on the composition of the etchant, the sacrifice layer may be unevenly etched to produce variations in the width of the surface opening of the ink supply port within a wafer surface.

Further, when etching is carried out using the etchant disclosed in Japanese Patent Application Laid-Open No. 2009-206335, as the etching of silicon progresses, the silicon may be eluted in the etchant to reduce the etching rate of aluminum. When etching of silicon further progresses, from a certain region, aluminum may be no longer etched to leave residue of the sacrifice layer. Leaving residue of the sacrifice layer may lower the performance of the ink jet recording head.

SUMMARY OF THE INVENTION

Accordingly, it is an object of the present invention to provide a method of producing a substrate for a liquid ejection head capable of etching a silicon substrate promptly and removing a sacrifice layer satisfactorily.

According to the present invention, there is provided a method of producing a substrate for a liquid ejection head including a liquid supply port formed therein, including: forming a sacrifice layer on a first surface of a silicon substrate in a region in which the liquid supply port is to open, the sacrifice layer containing aluminum which is selectively etched with respect to the silicon substrate; forming an etching mask on a second surface which is a rear surface of the first surface of the silicon substrate, the etching mask having an opening corresponding to the sacrifice layer; a first etching step of etching the silicon substrate by use of the etching mask as a mask and by use of a first etchant containing 8 mass % or more and less than 15 mass % of tetramethylammonium hydroxide; and after the first etching step, a second etching step of removing the sacrifice layer by use of a second etchant containing 15 mass % or more and 25 mass % or less of tetramethylammonium hydroxide.

Further features of the present invention will become apparent from the following description of exemplary embodiments with reference to the attached drawings.

DESCRIPTION OF THE EMBODIMENTS

An embodiment of the present invention is described in the following with reference to the attached drawings.

Note that, in the following description, a substrate for an ink jet head is described as an example to which the present invention may be applied, but the range of application of the present invention is not limited thereto. Further, the present invention may be applied not only to a method of producing a substrate for an ink jet head but also to a method of producing a substrate for a liquid ejection head, which is used for manufacturing a biochip or for printing an electronic circuit. Such a liquid ejection head includes an ink jet recording head, a head for manufacturing a color filter, and the like.

Figure 2:
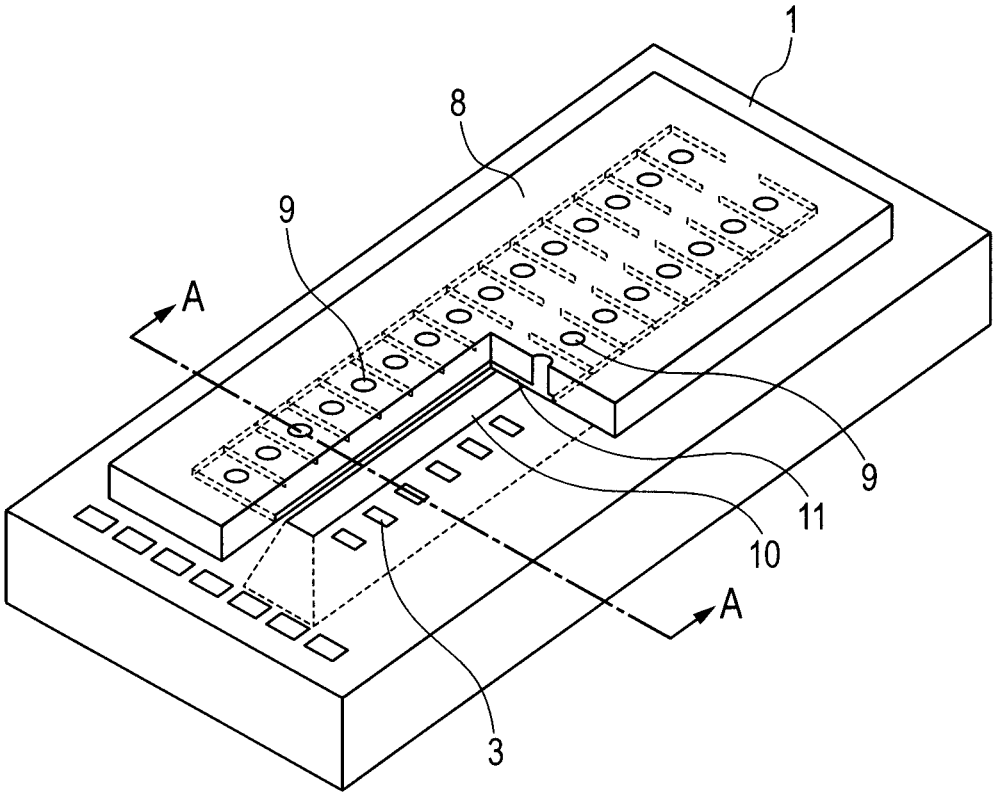
FIG. 2 is a schematic perspective view illustrating an exemplary structure of a liquid ejection head including the substrate for a liquid ejection head produced according to the embodiment of the present invention.

FIG. 2 is a schematic perspective view illustrating an exemplary ink jet recording head including a substrate for an ink jet head according to this embodiment. As illustrated in FIG. 2, the substrate for an ink jet head includes a silicon substrate 1 in which two lines of ejection energy generating elements 3 are arranged at a predetermined pitch. Ink ejection orifices (ejection orifices) 9, which open above ink flow paths (liquid flow paths) 11 and the ejection energy generating elements 3, are formed on the silicon substrate 1 by a flow path forming member. The ink flow paths 11 communicate to an ink supply port 10 and the ink ejection orifices 9. Further, the ink supply port 10 formed by anisotropic etching of silicon opens between the two lines of the ejection energy generating elements 3. In the ink jet recording head, pressure generated by the ejection energy generating elements 3 is applied to ink (liquid) which is filled via the ink supply port 10 into the ink flow paths 11, so as to eject ink droplets from the ink ejection orifices 9 to be adhered onto a recording medium, thereby performing recording.

Referring to FIGS. 1A to 1F, a method of producing the substrate for an ink jet head according to this embodiment is described.

FIGS. 1A to 1F are sectional views taken along the line A-A of FIG. 2 and illustrate basic producing steps for the substrate for an ink jet head according to this embodiment.

Figure 1A:
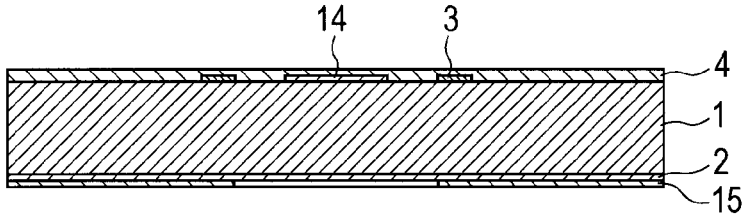
FIGS. 1A, 1B, 1C, 1D, 1E, and 1F are sectional views illustrating steps in a method of producing a substrate for a liquid ejection head according to an embodiment of the present invention.

As illustrated in FIG. 1A, a sacrifice layer 14 is formed on a front surface (first surface) of the silicon substrate 1 in a region in which the ink supply port 10 opens. Further, the multiple ejection energy generating elements 3 such as heat generating resistors are arranged on the front surface side of the silicon substrate 1. Further, a protective film 4 is formed on the silicon substrate 1 and the sacrifice layer 14. Still further, an oxide film 2 to be used as an etching mask material when the ink supply port 10 is formed in a post-process is formed on a rear surface (second surface opposite to the first surface) of the silicon substrate 1.

Wiring of the ejection energy generating elements and semiconductor elements for driving the ejection energy generating elements 3 are not shown. Further, the ejection energy generating elements 3, the sacrifice layer 14, and other elements and wiring are covered with the protective film 4.

Further, a mask material 15 for etching the oxide film 2 of the ink supply port 10 is formed by patterning in advance on the second surface which is the rear surface of the first surface of the silicon substrate 1.

By forming the sacrifice layer 14, a surface opening of the ink supply port (liquid supply port) may be formed with precision. The sacrifice layer contains aluminum and may be selectively etched by an etchant for a silicon substrate (alkaline solution). As the material of the sacrifice layer, for example, aluminum (Al), aluminum silicon (AlSi), aluminum copper (AlCu), or aluminum silicon copper (AlSiCu) may be used. Of those, aluminum or aluminum copper is preferred. AlSi is a compound containing Al and Si, AlCu is a compound containing Al and Cu, and AlSiCu is a compound containing Al, Si, and Cu.

The protective film 4 is resistant to etching with an etchant to be used in a post-process. As the protective film 4, for example, silicon oxide (SiO), silicon nitride (SiN), or silicon carbide (SiC) may be used.

Figure 1B:
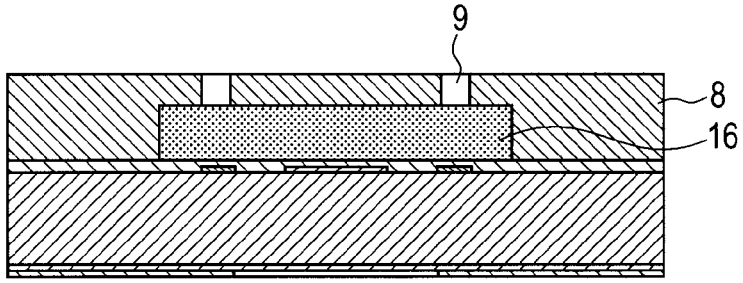

Then, as illustrated in FIG. 1B, a flow path mold material 16 to be a mold material of the ink flow paths 11 is formed on the substrate 1 illustrated in FIG. 1A, and a covering resin is used to form on the flow path mold material 16 a flow path forming member 8 having the ejection orifices 9 formed therein.

The flow path mold material 16 may be formed by, for example, applying a positive resist and then carrying out exposure and development. As the covering resin, a photosensitive resin may be used. The flow path forming member 8 having the ejection orifices 9 formed therein may be formed by, for example, applying a photosensitive resin by spin coating or the like and then carrying out exposure and development with ultraviolet radiation, deep UV radiation, or the like.

Figure 1C:
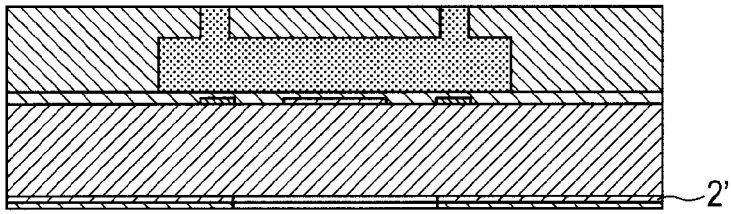

Then, as illustrated in FIG. 1C, the oxide film 2 is etched with the mask material 15 being used as the mask to form an etching mask 2' to be used for forming the ink supply port 10 in a post-process. The etching mask 2' has an opening corresponding to the sacrifice layer 14.

Figure 1D:
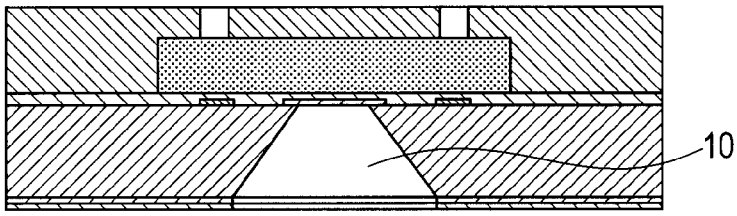

Next, as illustrated in FIG. 1D, a first etching step of etching the silicon substrate 1 is carried out by the use of the etching mask 2' as the mask and by the use of a first etchant. In the first etching step, the etching may be stopped in the middle of the silicon substrate 1, but it is preferred to carry out the etching until the sacrifice layer 14 is reached.

According to the present invention, as the first etchant, a solution having a high etching rate with regard to silicon is used.

More specifically, the first etchant contains 8 mass % or more and less than 15 mass % of tetramethylammonium hydroxide (TMAH).

When the concentration of TMAH is 8 mass % or more, the etching is stabilized and roughness of the surface of the silicon substrate 1 may be suppressed. When the concentration of TMAH is less than 15 mass %, the etching rate may be improved. The concentration of TMAH is preferably 10 mass % or more and is preferably 13 mass % or less.

It is preferred that the first etchant contain a silicon compound. This silicon compound is hereinafter referred to as a first silicon compound. The first silicon compound is a compound containing silicon. Exemplary silicon compounds include silicon-containing inorganic compounds and silicon-containing organic compounds. Exemplary silicon-containing inorganic compounds include metal silicon, fumed silica, colloidal silica, silica gel, silica sol, diatomaceous earth, acid clay, and activated clay. Exemplary silicon-containing organic compounds include an alkyl silicate and an alkyl silicic acid. Those may be used solely or in mixture.

The concentration of the first silicon compound is preferably 0.5 mass % or more and 8 mass % or less in the first etchant, and more preferably 0.8 mass % or more. When the concentration of the first silicon compound is 0.5 mass % or more, a region in which the etching rate with regard to silicon is unstable may be avoided. In particular, when the first etchant contains an inorganic alkali metal described below, if the content of the first silicon compound is high, the etching rate with regard to silicon may be reduced. Therefore, by setting the concentration of the first silicon compound to be 8 mass % or less, the etching rate may be improved.

The etching rate with regard to silicon may be 1.2 times to 1.5 times as much as that in the case of, for example, 22 mass % of TMAH only, through adjustment of the content of TMAH and the composition of the silicon compound.

Further, it is preferred that the first etchant further contain an inorganic alkali metal. Exemplary inorganic alkali metals include NaOH, KOH, and CsOH. If the first etchant contains 2 mass % of an inorganic alkali metal, the etching rate is further improved to be 1.5 times to twice. The concentration of the inorganic alkali metal may be 1 mass % or more and 10 mass % or less in the first etchant.

The temperature of the first etchant is not specifically limited, but, for example, may be 80° C.

Figure 1E:
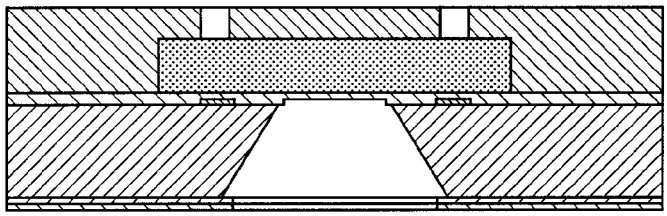

After the first etching step, as illustrated in FIG. 1E, a second etchant is used to remove the sacrifice layer 14. Using the second etchant, the sacrifice layer 14 is promptly removed. Here, the silicon may be etched.

The second etchant contains 15 mass % or more and 25 mass % or less of tetramethylammonium hydroxide (TMAH).

When the concentration of TMAH is 15 mass % or more, the evenness of the etched surface may be enhanced. When the concentration of TMAH is 25 mass % or less, the etching rate may be improved. The concentration of TMAH is preferably 18 mass % or more and preferably 22 mass % or less.

Further, it is preferred that the second etchant contain a second silicon compound. As the second silicon compound, the same silicon compound as the above-mentioned first silicon compound may be used. Note that, as the first silicon compound and the second silicon compound, different silicon compounds may be used.

It is preferred that the concentration of the second silicon compound be 0 mass % or more and 12 mass % or less in the second etchant. When the concentration is 12 mass % or less, roughness of the surface due to inhibition of etching may be suppressed. Further, the concentration of the second silicon compound is more preferably 0.1 mass % or more and 8 mass % or less, and still more preferably 0.1 mass % or more and 6 mass % or less. When the concentration of the second silicon compound is 0.1 mass % or more and 8 mass % or less in the second etchant, the etching rate with regard to silicon may be reduced and the sacrifice layer may be promptly removed. Therefore, the width of the opening of the ink supply port 10 may be constant.

The temperature of the second etchant is not specifically limited, but, for example, may be 80° C.

Further, the concentration of TMAH in the second etchant is preferably higher than the concentration of TMAH in the first etchant by 2 mass % or more, more preferably higher by 4 mass % or more, and still more preferably higher by 6 mass % or more.

Figure 1F:
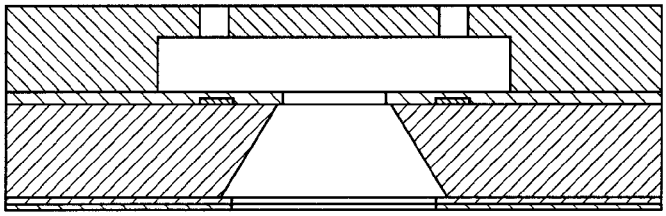

Then, as illustrated in FIG. 1F, part of the protective film 4 is removed. Then, the flow path mold material 16 is removed. Alternatively, the flow path forming member 8 may be thermally cured.

By the steps described above, the substrate 1 for an ink jet head having the ink supply port 10 formed therein may be produced.

EXAMPLES

Referring to FIGS. 1A to 1F, an example of a process for etching a silicon substrate used in an ink jet recording head is described. Note that, the present invention is not limited thereto.

Example 1

First, the silicon substrate 1 illustrated in FIG. 1A was prepared. The sacrifice layer 14 was formed on the silicon substrate 1 by the use of aluminum. Further, the multiple ejection energy generating elements 3 formed of heat generating resistors were arranged on the silicon substrate 1. As the material of the heat generating resistors, TaSiN was used. Further, the oxide film 2 used for the etching mask 2' for forming the ink supply port 10 was formed on the rear surface of the silicon substrate 1. The ejection energy generating elements 3, the sacrifice layer 14, and other elements and wiring were covered with the protective film 4. The mask material 15 for etching the oxide film 2 was formed by patterning in advance on the rear surface of the substrate 1. As the protective film 4, SiN was used. The mask material 15 was formed by patterning a polyimide.

Then, as illustrated in FIG. 1B, the flow path mold material 16 was formed on the substrate 1 by the use of a positive resist, and the flow path forming member 8 was formed on the flow path mold material 16.

As the material of the flow path mold material 16, ODUR (trade name, manufactured by TOKYO OHKA KOGYO CO., LTD.) as a positive photosensitive resin was used.

As the material of the flow path forming member 8, a negative photosensitive resin containing an epoxy resin, a cationic photopolymerization initiator, and xylene as a solvent was used. As the negative resist, a material containing 100 mass % of an epoxy resin EHPE3150 (trade name, manufactured by Daicel Corporation) and 6 mass % of a cationic photopolymerization catalyst SP-172 (trade name, manufactured by Asahi Denka Kogyo KK) was used. By applying the photosensitive resin by spin coating or the like and then carrying out exposure and development with ultraviolet radiation, deep UV radiation, or the like, the flow path forming member 8 having the ejection orifices 9 formed therein was formed.

Then, as illustrated in FIG. 1C, the oxide film 2 was etched by the use of BHF and by the use of the mask material 15 as the mask to form the etching mask 2'.

Then, as illustrated in FIG. 1D, as the first etchant, an etchant containing 10 mass % of TMAH, 1 mass % of CsOH, and the remaining mass percent of pure water (100 mass % in total) was used to etch the silicon substrate 1 (first etching step).

Then, as illustrated in FIG. 1E, as the second etchant, an etchant containing 22 mass % of TMAH and the remaining mass percent of pure water (100 mass % in total) was used to remove the sacrifice layer 14. By the second etchant, the sacrifice layer 14 was promptly removed. Here, part of the silicon substrate 1 was also etched.

Then, as illustrated in FIG. 1F, after part of the protective film 4 was etched, the flow path mold material 16 was removed.

According to the producing method of Example 1, the silicon substrate 1 could be promptly etched and the sacrifice layer 14 could be satisfactorily removed.

Example 2

A substrate for a liquid ejection head was produced similarly to the case of Example 1 except that the composition of the first etchant was 8 mass % of TMAH, 1 mass % of CsOH, and the remaining mass percent of pure water (100 mass % in total). Similarly to the case of Example 1, the silicon substrate 1 could be promptly etched and the sacrifice layer 14 could be satisfactorily removed.

Example 3

A substrate for a liquid ejection head was produced similarly to the case of Example 1 except that the composition of the first etchant was 14 mass % of TMAH, 1 mass % of CsOH, and the remaining mass percent of pure water (100 mass % in total). Compared with the case of Example 1, the silicon substrate 1 could be more promptly etched. Further, the sacrifice layer 14 could be satisfactorily removed.

Example 4

A substrate for a liquid ejection head was produced similarly to the case of Example 1 except that the composition of the first etchant was 8 mass % of TMAH, 1 mass % of colloidal silica, and the remaining mass percent of pure water (100 mass % in total). Similarly to the case of Example 1, the silicon substrate 1 could be promptly etched and the sacrifice layer 14 could be satisfactorily removed.

Example 5

A substrate for a liquid ejection head was produced similarly to the case of Example 1 except that the composition of the first etchant was 8 mass % of TMAH, 1 mass % of CsOH, 1 mass % of colloidal silica, and the remaining mass percent of pure water (100 mass % in total). Similarly to the case of Example 1, the silicon substrate 1 could be promptly etched and the sacrifice layer 14 could be satisfactorily removed. In addition, the etching rate was more stable than in the case of Example 1.

Example 6

A substrate for a liquid ejection head was produced similarly to the case of Example 1 except that the composition of the second etchant was 15 mass % of TMAH and the remaining mass percent of pure water (100 mass % in total). Similarly to the case of Example 1, the silicon substrate 1 could be promptly etched and the sacrifice layer 14 could be satisfactorily removed.

Example 7

A substrate for a liquid ejection head was produced similarly to the case of Example 1 except that the composition of the second etchant was 25 mass % of TMAH and the remaining mass percent of pure water (100 mass % in total). Similarly to the case of Example 1, the silicon substrate 1 could be promptly etched and the sacrifice layer 14 could be satisfactorily removed.

Comparative Example 1

A substrate for a liquid ejection head was produced similarly to the case of Example 1 except that the composition of the first etchant was 7 mass % of TMAH, 1 mass % of CsOH, and the remaining mass percent of pure water (100 mass % in total). Compared with the case of Example 1, roughness of the surface of the liquid supply port 10 of the silicon substrate 1 was observed.

Comparative Example 2

A substrate for a liquid ejection head was produced similarly to the case of Example 1 except that the composition of the first etchant was 16 mass % of TMAH, 1 mass % of CsOH, and the remaining mass percent of pure water (100 mass % in total). Compared with the case of Example 1, the time taken to etch the silicon substrate 1 was longer.

Comparative Example 3

A substrate for a liquid ejection head was produced similarly to the case of Example 5 except that the composition of the second etchant was the same as the composition of the first etchant. Compared with the case of Example 5, the sacrifice layer 14 could not be satisfactorily etched and variations in the width of the opening of the ink supply port 10 were produced.

According to the present invention, a method of producing a substrate for a liquid ejection head capable of etching a silicon substrate promptly and removing a sacrifice layer satisfactorily can be provided. The silicon substrate is etched promptly, and thus, the productivity is improved. Further, the sacrifice layer is removed satisfactorily, and thus, the width of an opening of a liquid supply port is formed with precision. Therefore, a substrate for a liquid ejection head which exhibits satisfactory ejection characteristics can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-093014, filed Apr. 19, 2011, which is hereby incorporated by reference herein in its entirety.

What is claimed is:

1. A method of producing a substrate for a liquid ejection head including a liquid supply port formed therein, comprising:

forming a sacrifice layer on a first surface of a silicon substrate in a region in which the liquid supply port is to open, the sacrifice layer containing aluminum which is selectively etched with respect to the silicon substrate;

forming an etching mask on a second surface which is a rear surface of the first surface of the silicon substrate, the etching mask having an opening corresponding to the sacrifice layer;

a first etching step of etching the silicon substrate by use of the etching mask as a mask and by use of a first etchant containing 8 mass % or more and less than 15 mass % of tetramethylammonium hydroxide; and after the first etching step, a second etching step of removing the sacrifice layer by use of a second etchant containing 15 mass % or more and 25 mass % or less of tetramethylammonium hydroxide.

2. The method of producing a substrate for a liquid ejection head according to claim 1, wherein the first etchant contains a first silicon compound.

3. The method of producing a substrate for a liquid ejection head according to claim 1, wherein the first etchant contains an inorganic alkali metal.

4. The method of producing a substrate for a liquid ejection head according to claim 2, wherein a concentration of the first silicon compound is 0.5 mass % or more and 8 mass % or less in the first etchant.

5. The method of producing a substrate for a liquid ejection head according to claim 1, wherein the second etchant contains a second silicon compound.

6. The method of producing a substrate for a liquid ejection head according to claim 5, wherein a concentration of the second silicon compound is 0.1 mass % or more and 12 mass % or less in the second etchant.

7. The method of producing a substrate for a liquid ejection head according to claim 3, wherein the inorganic alkali metal comprises one of NaOH, KOH, and CsOH.

8. The method of producing a substrate for a liquid ejection head according to claim 1, wherein the second etchant contains 15 mass % or more and 22 mass % or less of tetramethylammonium hydroxide.

9. The method of producing a substrate for a liquid ejection head according to claim 1, wherein the second etchant contains 18 mass % or more and 25 mass % or less of tetramethylammonium hydroxide.

10. The method of producing a substrate for a liquid ejection head according to claim 2, wherein the concentration of the first silicon compound in the first etchant is 0.8 mass % or more and 8 mass % or less.

* * * * *